US007002124B2

(12) United States Patent
Kim et al.

(10) Patent No.: US 7,002,124 B2
(45) Date of Patent: Feb. 21, 2006

(54) MICROWAVE OVEN

(75) Inventors: Eung-Su Kim, Seoul (KR); Yang-Kyeong Kim, Bucheon (KR); Young-Min Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/665,527

(22) Filed: Sep. 22, 2003

(65) Prior Publication Data

US 2004/0056028 A1 Mar. 25, 2004

(30) Foreign Application Priority Data

Sep. 23, 2002 (KR) ..... 10-2002-0057588
Sep. 5, 2003 (KR) ..... 10-2003-0062278

(51) Int. Cl.
*H05B 6/64* (2006.01)
*H05B 6/76* (2006.01)

(52) U.S. Cl. ..... 219/739; 219/678; 219/741

(58) Field of Classification Search ..... 219/739, 219/740, 756, 757, 741, 742; 174/35 R, 174/35 GC; 126/190, 198, 214; D7/347–349, D7/351, 405
See application file for complete search history.

(56) References Cited

U.S. PATENT DOCUMENTS

| | | | | | |
|---|---|---|---|---|---|
| 3,965,325 | A | * | 6/1976 | Hirai | 219/739 |
| D242,421 | S | * | 11/1976 | Pitstick et al. | D7/351 |
| 4,861,956 | A | * | 8/1989 | Courneya | 219/696 |
| 5,726,427 | A | * | 3/1998 | Hwang | 219/739 |
| D463,200 | S | * | 9/2002 | Choi | D7/351 |
| 2003/0141298 | A1 | * | 7/2003 | Lee et al. | 219/741 |

FOREIGN PATENT DOCUMENTS

| | | | |
|---|---|---|---|
| EP | 0 858 247 | A2 | 8/1998 |
| GB | 2280829 | A * | 2/1995 |
| JP | 63-43287 | A | 2/1988 |
| JP | 2002-31351 | A | 1/2002 |

* cited by examiner

*Primary Examiner*—Quang Van
(74) *Attorney, Agent, or Firm*—Birch, Stewart, Kolasch & Birch, LLP

(57) ABSTRACT

A microwave oven has a casing which forms an appearance and has a front surface backwardly slanted and an adjusting portion formed at the slanted part; a cooking chamber formed inside the casing, for cooking food; and a door rotatably combined, i.e., hinged, at a side of the casing and slanted correspondingly the casing in order to opening and close the front surface of the cooking chamber.

4 Claims, 9 Drawing Sheets

MICROWAVE OVEN

This nonprovisional application claims priority under 35 U.S.C. § 119(a) on Patent Application No. 2002-0057588 filed in KOREA on Sep. 23, 2002 and Application No. 2003-62278 filed in Korea on Sep. 5, 2003 which are herein incorporated by reference.

BACKGROUND OF THE INVENTION

1. Field of the Invention

The present invention relates to a microwave oven and particularly, to a microwave oven, capable of improving adjustment of the microwave oven and visibility of a cooking chamber and efficiently preventing electromagnetic wave.

2. Description of the Conventional Art

Generally, a microwave oven is a heating and cooking device for a cooking object by generating electromagnetic wave and by penetrating the generated electromagnetic wave into the cooking object.

FIG. 1 is a perspective view showing an opened condition of a door in a microwave oven in accordance with the conventional art, FIG. 2 is a perspective view showing a closed condition of the door of the conventional microwave oven, FIG. 3 is a longitudinal sectional view taken along line A—A of FIG. 2, FIG. 4 is a lateral view for explaining a user's viewing angle for an adjusting portion when the door is closed according to the conventional art, and FIG. 5 is a view for explaining a user's viewing angle for inside of a cooking chamber when the door is opened according to the conventional art.

As shown in FIGS. 1 to 3, the conventional microwave oven of a square shape includes a casing 1 which forms an appearance of a microwave oven; a cooking chamber 2 formed in the casing 1, for cooking food; and a door 3 rotably combined at a side of the casing 1, for opening and closing a front portion of the cooking chamber 2.

An adjusting portion 4 for selecting various cooking modes is positioned on a front surface of the casing 1.

The door 3 is positioned at the front surface of the casing 1 and rotably installed to open and close the cooking chamber 2.

The door 3 includes a door frame 3A formed of iron material and facing the casing 1; a door panel 3B formed of synthetic resin and combined to an outer surface of the door frame 3A; a transparent window 3C for viewing inside of the cooking chamber 2; and a cover chock 3D for covering the door frame 3A.

The door frame 3B is provided with a chock seal S for preventing leakage of electromagnetic wave at an inner portion of an edge thereof.

The usage and operation of the conventional microwave oven will be explained.

First, when the microwave oven is activated by selecting the adjusting portion 4 after putting a cooking object in the cooking chamber 2 and closing the door 3, the cooking object is heated and cooked by electromagnetic wave generated in a magnetron (not shown) and radiant heat generated in a halogen heater (not shown) installed in the cooking chamber 2.

However, in case of the conventional microwave oven, as shown in FIGS. 4 and 5, the front surface of the casing 1 is vertically formed, the adjusting portion 4 is installed at the front surface of the casing 1, and inside of the cooking chamber 2 is shielded by the casing 1, so that the user can have a difficulty in adjusting the adjusting portion 4 or viewing inside of the cooking chamber 2.

In other words, as the microwave oven is commonly installed and used in a position which is lower than the user's stature, when the door is closed in the conventional microwave oven as shown in FIG. 4, the user's viewing angle ($\Theta_1$) for the adjusting portion 4 becomes small. According to this, the user can not view the adjusting portion 4 and thus to have a difficulty in adjusting the adjusting portion 4.

Also, as shown in FIG. 5, when the door is opened in the conventional microwave oven, the cooking chamber 2 is shielded by the casing 1 itself and thus the user's viewing angle for inside of the cooking chamber 2 becomes small. According to this, it is difficult to view inside of the cooking chamber 2.

Therefore, in order to adjust the adjusting portion 4 or to certify an operation of the adjusting portion 4, the user had to bend his waist or head and thereby had inconvenience very much.

In spite of these disadvantages, the reason why the casing and the door must be manufactured in a square box type will be described as follows.

In case that the casing and the door are manufactured in a bending shape with a predetermined curvature and angle to improve adjustment of the adjusting portion and a visibility for inside of the cooking chamber, it is hard to maintain a gap between the casing and the door small and uniformly due to deformation generated during the usage.

That is, to effectively improve electromagnetic wave, the gap between the casing and the door must be small and regularly maintained. However, a processing to bend the casing and the door with a predetermined curvature is difficult and deformation is generated even if the bending processing was performed, so that the gap between the casing and the door becomes great and thus electromagnetic wave is not effectively cut-off.

By this reason, it was difficult to bend the casing and the door with a predetermined curvature or angle, and the adjusting portion installed in the casing had to be installed in a position where the user has a difficulty in adjusting.

SUMMARY OF THE INVENTION

Therefore, an object of the present invention is to provide a microwave oven capable of enabling a user to adjust or check an adjusting portion and look into inside of a cooking chamber while cooking or before/after cooking by forming an upper front portion of a casing and a door slantly with a predetermined angle and installing the adjusting portion on the slanted surface, and capable of efficiently cutting off electromagnetic wave by considering a thickness and a width of the door.

To achieve these and other advantages and in accordance with the purpose of the present invention, as embodied and broadly described herein, there is provided a microwave oven comprising: a casing which forms an appearance and has a front surface backwardly slanted and an adjusting portion formed at the slanted part; a cooking chamber formed inside the casing, for cooking food; and a door rotably combined at a side of the casing and slanted correspondingly the casing in order to opening and close the front surface of the cooking chamber.

The door includes: a door frame formed of iron material and facing the casing; a door panel combined at an outer surface of the door frame and injected with synthetic resin;

a transparent window for viewing inside of the cooking chamber; and a chock cover for covering the door frame.

The door frame includes: a contact portion inwardly curved to face the casing; an inductance portion for forming an inductance by being extended and curved from the contact portion; and a capacitor portion curved from the inductance portion, for forming a capacitance.

An LC resonant circuit includes: a first capacitance $C_1$; an inductance L connected to the first capacitance $C_1$; and a second capacitance $C_2$ connected to the inductance L in parallel.

A ratio between a width and a thickness of the door frame is 0.8~0.95.

A cutting portion for preventing the door frame from being deformed is formed at an inner wall surface of the door frame.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 6:
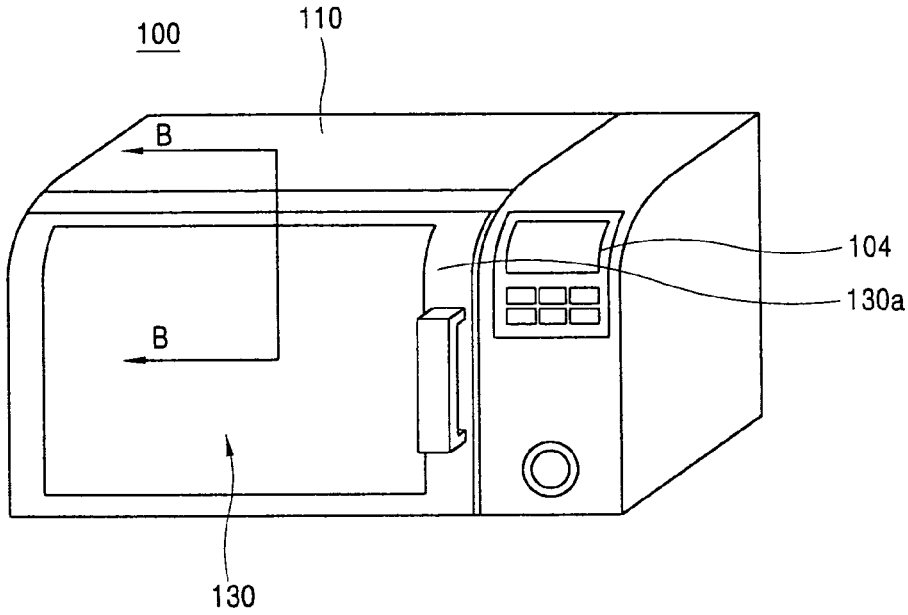
FIG. 6 is a disassembled perspective view showing a microwave oven according to the present invention.
Figure 7:
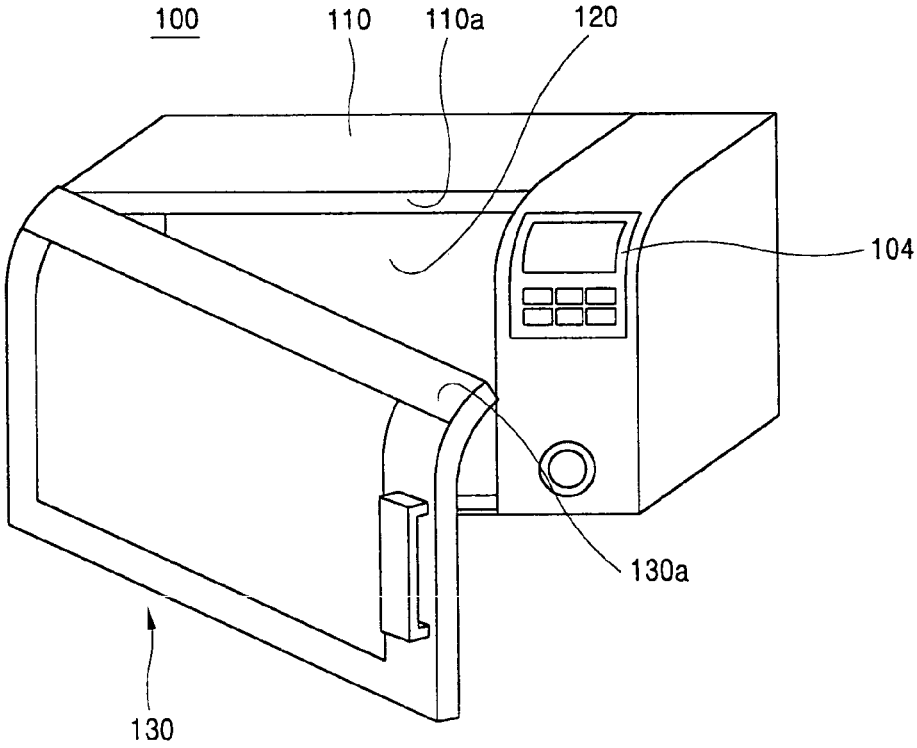
FIG. 7 is an assembled perspective view showing a microwave oven according to the present invention.

FIG. 6 is a disassembled perspective view showing a microwave oven according to the present invention, and FIG. 7 is an assembled perspective view showing a microwave oven according to the present invention.

As shown, a microwave oven 100 according to the present invention comprises: a casing 110 forming an appearance thereof; a cooking chamber 120 formed in the casing 110, for cooking food; and a door 130 rotably combined at a side of the casing 110, for opening and closing a front surface of the cooking chamber 120.

At a curved surface portion 110*a* of the casing 110, an adjusting portion 104 for selecting a cooking mode by adjusting a magnetron (not shown) and other components is installed with an upwardly slanted state.

The casing 110 has an upper front portion which is formed in a rounded or bent shape with a predetermined curvature, and the door 130 has an upper front portion rounded with the same curvature or bent with a certain angle while maintaining a certain interval from the casing 110 correspondingly a shape of the casing 110.

That is, the curved surface portion 110 of a rounded shape is formed at the upper portion of the casing 110, and a curved surface portion 130*a* of a rounded shape which corresponds to a front surface of the curved surface portion 110*a* of the casing 110 is also formed at the upper portion of the door 130.

Figure 8:
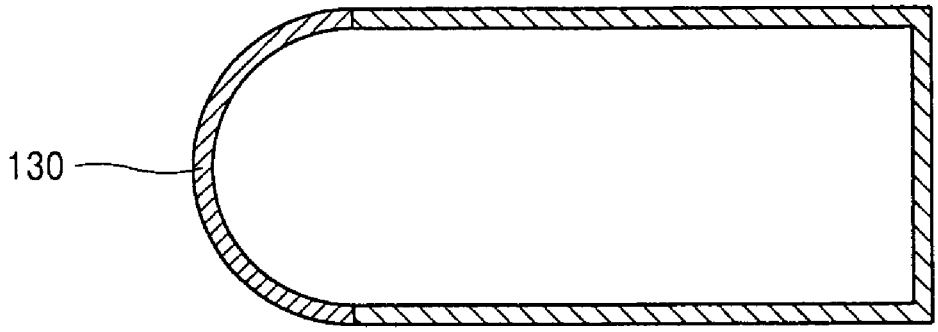
FIGS. 8 and 9 are longitudinal section views showing another embodiment of a microwave oven according to the present invention.
Figure 9:
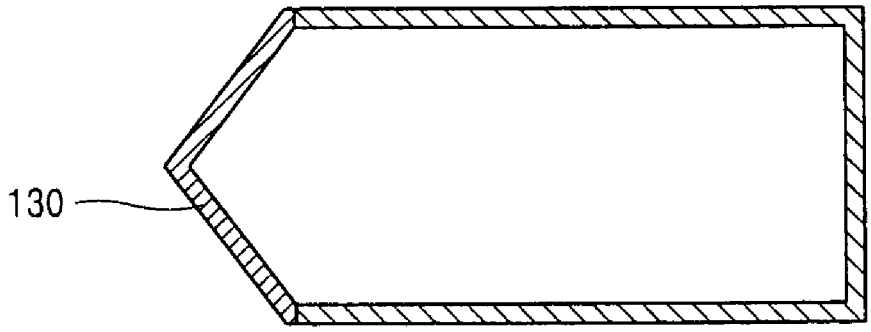
Figure 10:
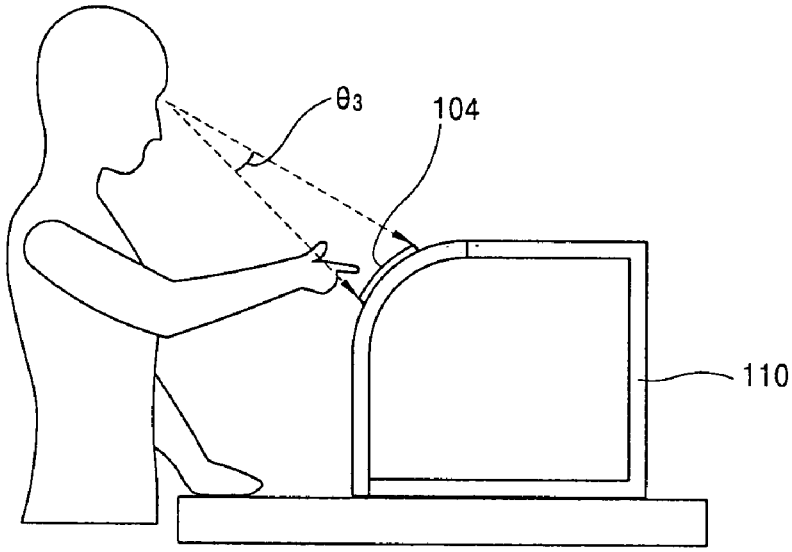
FIG. 10 is a lateral view for explaining a user's viewing angle for an adjusting portion when a door is closed in a microwave oven according to the present invention.
Figure 11:
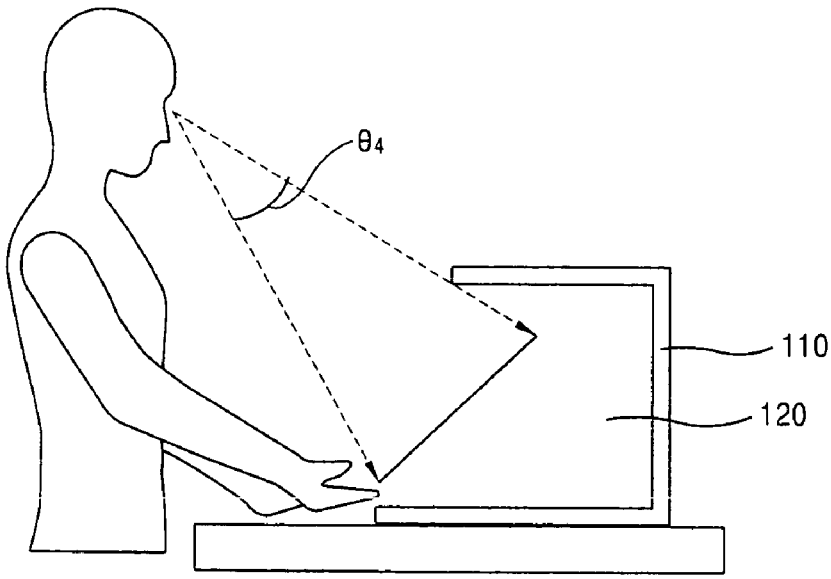
FIG. 11 is a lateral view for explaining a user's viewing angle for inside of a cooking chamber when a door is opened in a microwave oven according to the present invention.

A shape of the microwave oven according to the present invention can be rounded from a middle portion of the front surface to an upper end portion with a predetermined curvature as shown in FIG. 8, or can be deformed as shown in FIGS. 9 to 11.

FIGS. 8 and 9 are longitudinal section views showing another embodiment of the microwave oven according to the present invention.

The microwave oven can be rounded from a lower end portion of the front surface to an upper end with a predetermined curvature as shown in FIG. 8, and can be bent with a predetermined angle at a middle portion of the front surface as shown in FIG. 9.

FIG. 10 is a lateral view for explaining a user's viewing angle for an adjusting portion when a door is closed in a microwave oven according to the present invention, and FIG. 11 is a lateral view for explaining a user's viewing angle for inside of a cooking chamber when a door is opened in a microwave oven according to the present invention.

Figure 1:
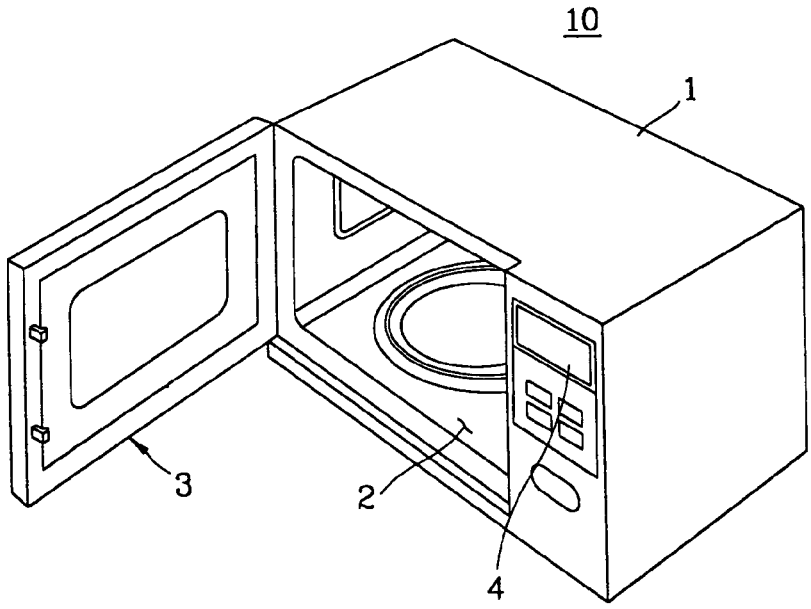
FIG. 1 CONVENTIONAL ART
FIG. 1 is a perspective view showing an opened condition of a door in a microwave oven in accordance with the conventional art.
Figure 2:
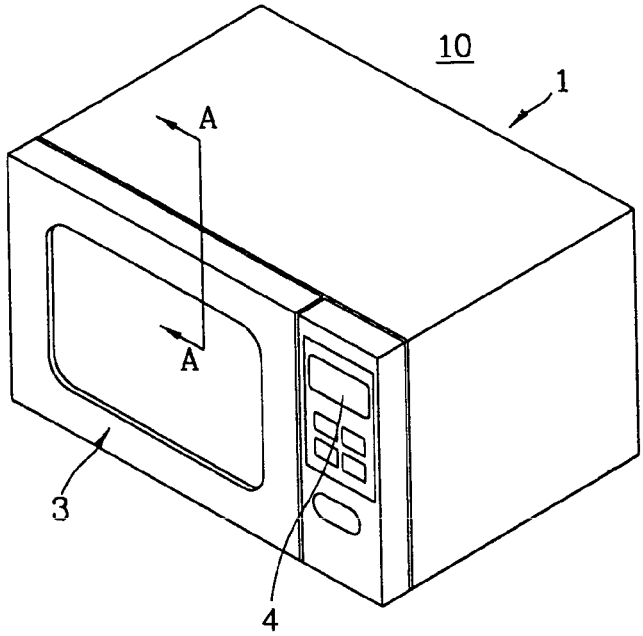
FIG. 2 CONVENTIONAL ART
FIG. 2 is a perspective view showing a closed condition of the door of the conventional microwave oven.
Figure 3:
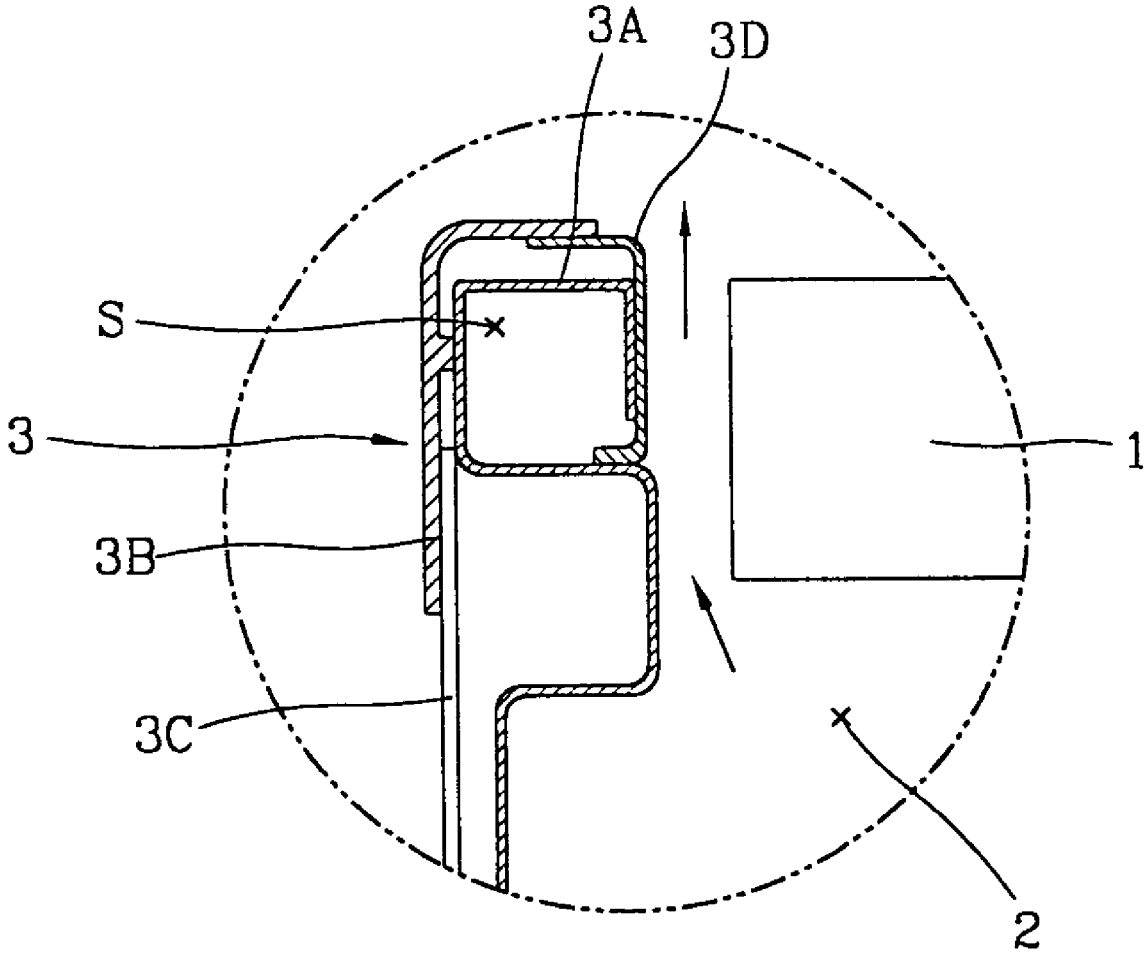
FIG. 3 CONVENTIONAL ART
FIG. 3 is a longitudinal sectional view taken along line A—A of FIG. 2.
Figure 4:
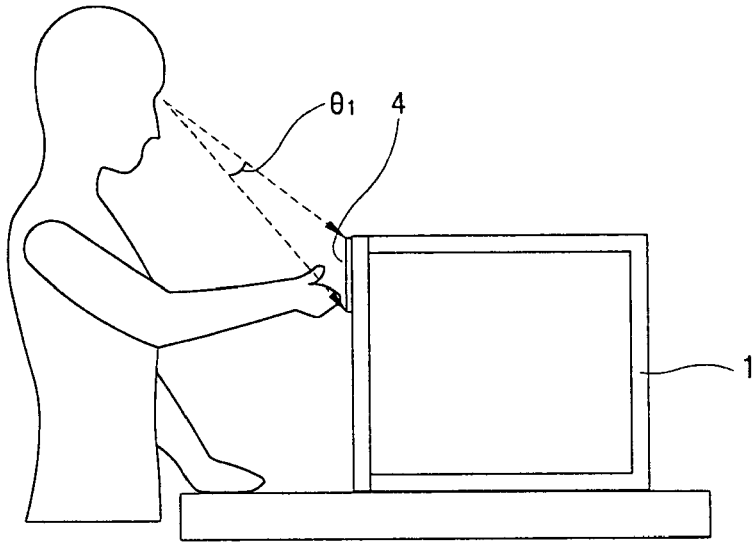
FIG. 4 CONVENTIONAL ART
FIG. 4 is a lateral view for explaining a user's viewing angle for an adjusting portion when the door is closed according to the conventional art.

As shown in FIG. 10, when the door of the microwave oven 110 is closed, the user's viewing angle $\Theta_3$ for the adjusting portion 104 becomes larger than the viewing angle $\Theta_1$ of FIG. 4, thereby easily adjusting the adjusting portion 104.

Figure 5:
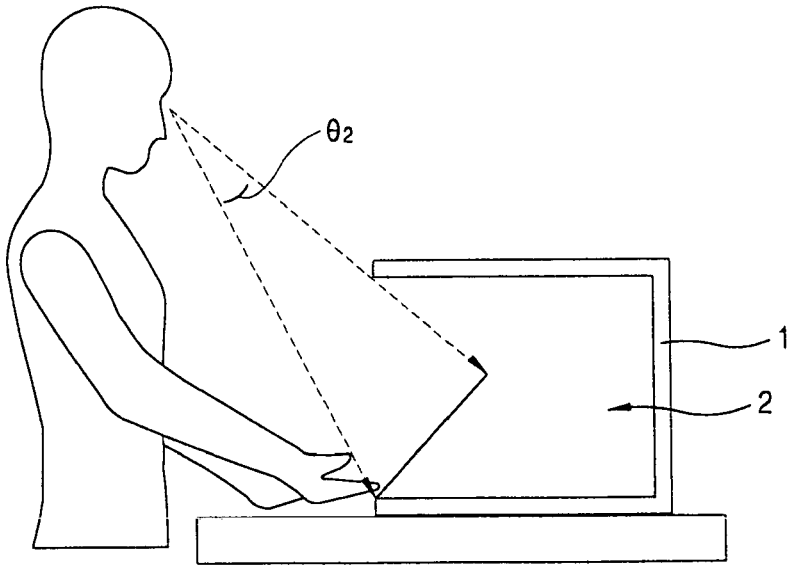
FIG. 5 CONVENTIONAL ART
FIG. 5 is a view for explaining a user's viewing angle for inside of a cooking chamber when the door is opened according to the conventional art.

Also, as shown in FIG. 11, when the door of the microwave oven 110 is opened, the user's viewing angle $\Theta_4$ for inside of the cooking chamber 120 becomes larger than the viewing angle $\Theta_3$ of FIG. 5, thereby easily looking into the cooking chamber 120.

Since the user can easily adjust the adjusting portion 104 and can easily look into the cooking chamber 120 at the time of certifying an operation of the adjusting portion 104 while cooking or before/after cooking, the usage of the microwave oven becomes very convenient.

Figure 12:
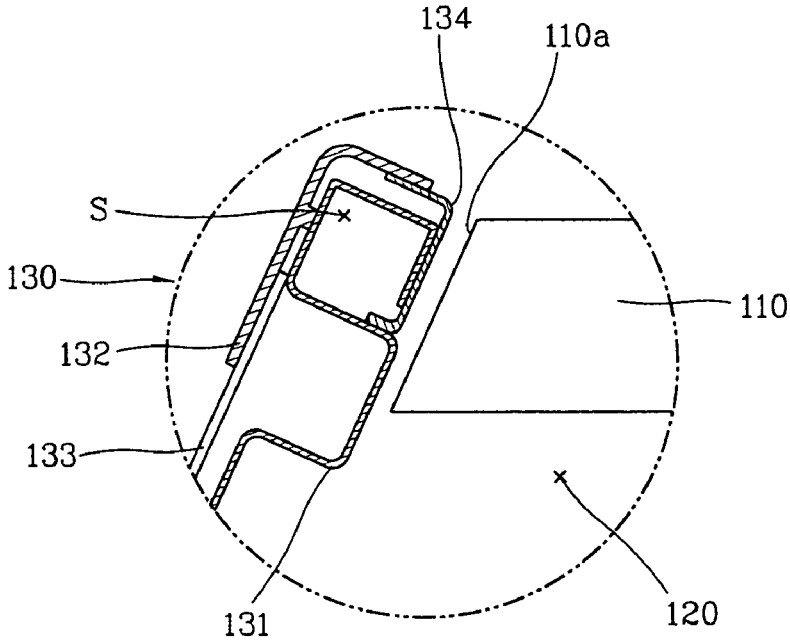
FIG. 12 is a section view taken along line B—B of FIG. 7.

As shown in FIG. 12, the door 130 includes a door frame 131 formed of iron material and facing the casing 110; a door panel 132 injected with synthetic resin and combined to an outer surface of the door frame 131; a transparent window 133 for viewing inside of the cooking chamber 120; and a chock cover 134 for covering the door frame 131.

With such microwave oven of the present invention, the user opens the door 130 to cook food, puts food in the cooking chamber 120, closes the door 130, adjusts the adjusting portion 104, and thereby starts to cook food.

At this time, as the adjusting portion 104 is installed on the curved surface portion 110*a* of the casing 110, the user can adjust the adjusting portion 104 without bending his waist or head and thus can use the microwave oven very conveniently.

Also, even when the user looks into the cooking chamber 120 through the transparent window 133 of the door 130 to check a cooking state of the food during cooking, as the upper portion of the door 130 including the transparent window 133 is formed to be bent with a predetermined curvature, the user can easily observe the food in the cooking chamber 120 without bending his waist or head and thus the usage is very convenient.

Figure 13:
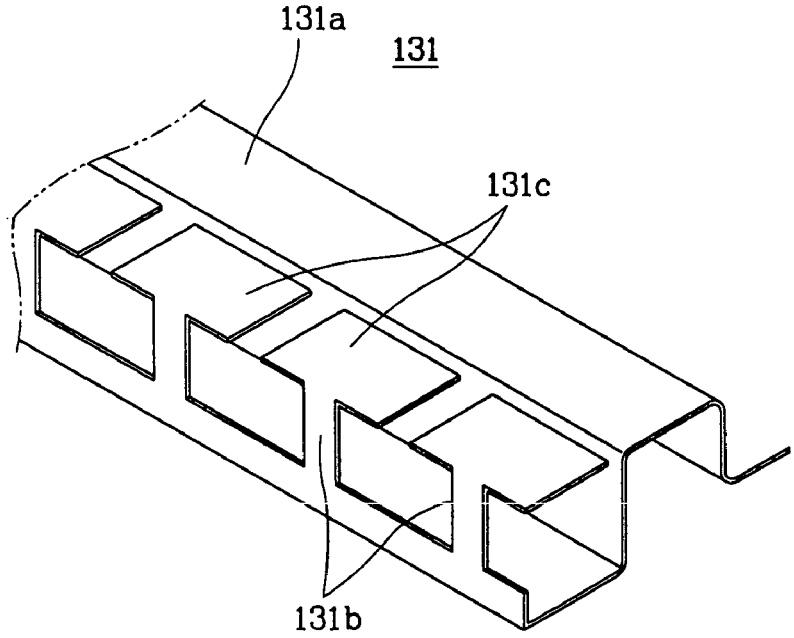
FIG. 13 is a perspective view showing a part of a door frame according to the present invention.

As shown in FIG. 13, the door frame 131 of the present invention includes: a contact portion 131*a* inwardly curved to face the casing 110; an inductance portion 131*b* for forming an inductance by being extended and curved from the contact portion 131*a*; and a capacitor portion 131*c* curved from the inductance portion 131*b*, for forming a capacitance.

Since electromagnetic wave (frequency 2.45 GHz) generated in a magnetron (not shown) of a microwave oven is harmful for human body and also badly affects on other electronics and electrical products, a choke has to be constructed in order to prevent the wave from leaking to outside. To this end, in the microwave oven of the present invention, a choke of an LC resonant electromagnetic wave cut-off structure for attenuating electromagnetic wave is formed in the door by considering a thickness and a width of the door 130, thereby efficiently preventing electromagnetic wave from being leaked.

Hereinafter, the electromagnetic wave cut-off structure of the microwave oven according to the present invention will be explained.

Figure 14:
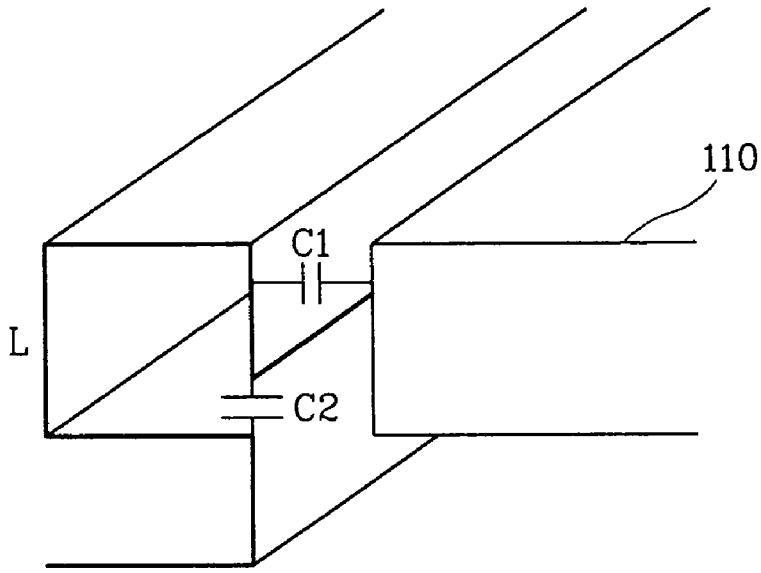
FIG. 14 is a perspective view showing a capacitance and an inductance of a choke in a microwave oven according to the present invention.
Figure 15:
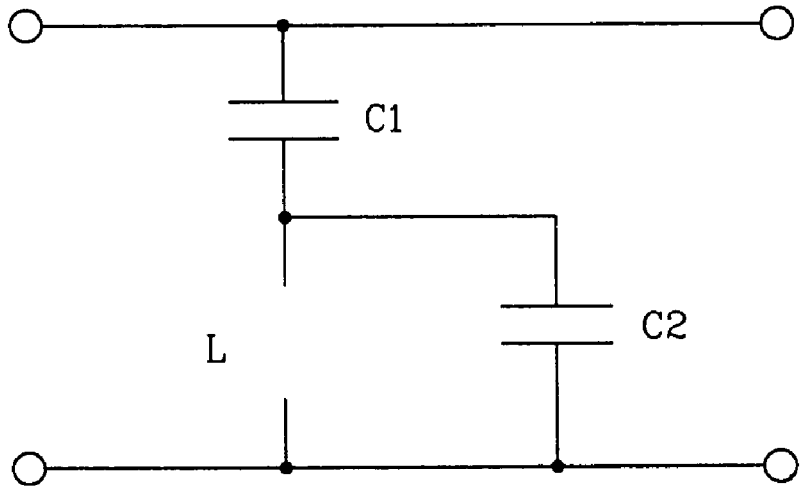
FIG. 15 is an LC circuit of a choke applied to a microwave oven according to the present invention.

FIG. 14 is a perspective view showing a capacitance and an inductance in a microwave oven according to the present invention, and FIG. 15 is an LC circuit applied to a microwave oven according to the present invention.

As shown, the LC resonant circuit includes: a first capacitance $C_1$; an inductance L connected to the first capacitance $C_1$; and a second capacitance $C_2$ connected to the inductance L in parallel.

A resonant frequency $f_0$ determined by the inductance and the capacitance is expressed as a formula of $$f_0 = \frac{1}{2\pi\sqrt{LC}}.$$

At this time, if a frequency f which has been incident on a transmission line and progressing is the same as the resonant frequency $f_0$, electromagnetic wave is filtered and shielded up. Herein, L denotes a whole inductance and C denotes a whole capacitance. Herein, as a transmission line is cut off, incident frequency which progresses is all shielded.

Figure 16:
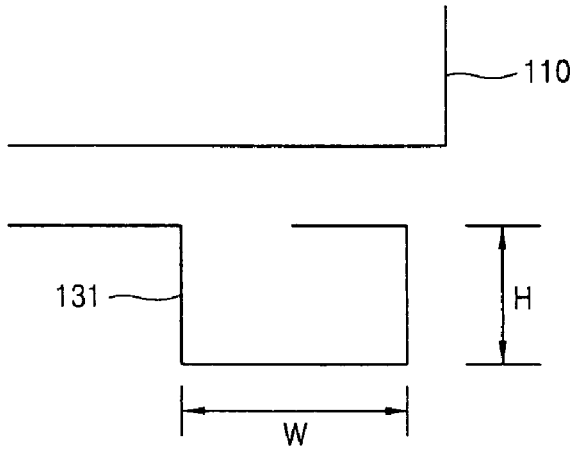
FIG. 16 is a view for explaining a ratio between a thickness and a width of a door frame in a microwave oven according to the present invention.

FIG. 16 is a view for explaining a ratio between a thickness and a width of a door frame in a microwave oven according to the present invention.

As shown, in the microwave oven of the present invention, a ratio between a thickness H and a width W of the door frame 131 of the door is properly controlled to vary the resonant frequency $f_0$, thereby adjusting a bandwidth to be cut-off and thus attenuating frequency.

That is, in the microwave oven of the conventional art, a ratio between a with and a thickness was 1.1~1.2, in which the thickness was relatively thicker. Contrary to this, In the microwave oven of the present invention, a ratio between a width and a thickness is optimized as 0.8~0.95.

In order to design the ratio between a width and a thickness as 0.8~0.95, a thickness has to be relatively smaller than a width. If the width becomes great, the capacitor C becomes great. Therefore, on the basis of the formula of $$f_0 = \frac{1}{2\pi\sqrt{LC}},$$

in order to constantly maintain the resonant frequency $f_0$, the inductance L has to be small and the capacitance C has to be great.

Generally, if the inductance L becomes small and the capacitor C becomes great, a frequency band becomes wide thus to have an improved electromagnetic wave filtering characteristic. In the present invention, by using this principle, an electromagnetic wave cut-off characteristic according to a frequency variation can be enhanced.

Figure 17:
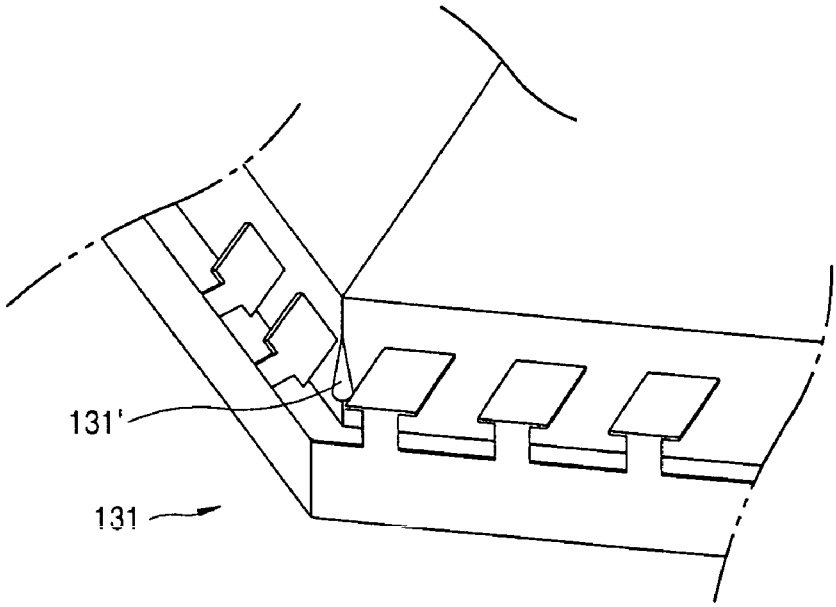
FIG. 17 is a view showing a cutting portion of a door frame in a microwave oven according to the present invention.

FIG. 17 is a view showing a cutting portion of a door frame in a microwave oven according to the present invention.

As shown in FIG. 17, in case of curvedly forming the upper front surface of the casing and the door with a predetermined curvature, an interference or an overlapping are generated at a curved part of the door frame 131 and thereby a deformation can be generated at a lateral wall surface of the door frame 131. To solve this, a cutting portion 131' of a hole shape is formed at the lateral wall surface of the door frame 131.

Like this, in the microwave oven of the present invention, the upper front surface of the casing and the door are slantly formed with a certain angle and the adjusting portion is installed at the slanted surface, so that it is convenient to adjust and check the adjusting portion for cooking. Also, it is convenient to look into the cooking chamber (increased visibility) while cooking or before/after cooking, and electromagnetic wave can be effectively cut-off by properly controlling the ratio between the width and the thickness of the door.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A microwave oven comprising:

a cooking chamber formed inside the casing, for cooking food; and a door rotatably combined at a side of the casing and slanted correspondingly to the casing in order to open and close the front of the cooking chamber, wherein the door comprises:

a door frame formed of iron material and facing the casing;

a door panel combined at an outer surface of the door frame and injected with synthetic resin;

a transparent window for viewing inside of the cooking chamber; and a chock cover for covering the door frame, and the door frame comprises:

a contact portion inwardly curved to face the casing;

an inductance portion for forming an inductance by being extended and curved from the contact portion; and a capacitor portion curved from the inductance portion, for forming a capacitance.

2. The microwave oven of claim 1, wherein a ratio between a width and a thickness of the door frame is 0.8~0.95.

3. A microwave oven comprising:

a casing which forms an appearance and has a front surface backwardly slanted and an adjusting portion formed at the slanted part;

a cooking chamber formed inside the casing, for cooking food; and a door rotatably attached to a side of the casing and slanted to corresponding to the casing in order to open and close the front of the cooking chamber and, wherein an LC resonant circuit of the door comprises:

a first capacitance $C_1$;

an inductance L connected to the first capacitance $C_1$; and a second capacitance $C_2$ connected to the inductance L in parallel.

4. A microwave oven comprising:

a casing which form an appearance and has a front surface backwardly slanted and an adjusting portion formed at the slanted part;

a cooking chamber formed inside the casing, for cooking food; and a door rotatably combined at a side of the casing to rotate about a substantially vertical axis formed by the side of the casing and slanted correspondingly to the casing in order to open and close the front of the cooking chamber;

wherein a cutting portion for preventing the door frame from being deformed is formed at an inner wall surface of the door frame.

* * * * *